US007093448B2

(12) United States Patent
Nguyen et al.

(10) Patent No.: US 7,093,448 B2
(45) Date of Patent: Aug. 22, 2006

(54) MULTI-ACTION ON MULTI-SURFACE SEAL WITH TURBINE SCROLL RETENTION METHOD IN GAS TURBINE ENGINE

(75) Inventors: Ly D. Nguyen, Phoenix, AZ (US); Gregory O. Woodcock, Mesa, AZ (US); Stony Kujala, Tempe, AZ (US)

(73) Assignee: Honeywell International, Inc., Morristown, NJ (US)

( * ) Notice: Subject to any disclaimer, the term of this patent is extended or adjusted under 35 U.S.C. 154(b) by 178 days.

(21) Appl. No.: 10/682,217

(22) Filed: Oct. 8, 2003

(65) Prior Publication Data

US 2005/0076643 A1 Apr. 14, 2005

(51) Int. Cl.
*F02C 3/00* (2006.01)
*F23R 3/42* (2006.01)

(52) U.S. Cl. ..... 60/798; 60/800

(58) Field of Classification Search ..... 60/798, 60/799, 800, 805; 415/204, 205, 184
See application file for complete search history.

(56) References Cited

U.S. PATENT DOCUMENTS 2,648,491 A * 8/1953 Wood ..... 60/805
2,801,519 A * 8/1957 Wood ..... 60/805
2,895,295 A * 7/1959 Carlson ..... 60/791
3,849,022 A * 11/1974 Amann et al. ..... 415/116
3,982,390 A 9/1976 Bell
4,009,568 A 3/1977 King et al.
4,030,288 A 6/1977 Davis et al.
5,136,837 A 8/1992 Davison
5,301,957 A 4/1994 Hwang et al.
5,317,865 A * 6/1994 Inoue et al. ..... 60/804
6,287,091 B1 9/2001 Svihla et al.
6,582,190 B1 6/2003 Jinnai
6,594,995 B1 7/2003 Heyes

FOREIGN PATENT DOCUMENTS

JP 4-303135 * 10/1992
JP 10-068330 3/1998

* cited by examiner

*Primary Examiner*—Ted Kim
(74) *Attorney, Agent, or Firm*—Ingrassia Fisher & Lorenz

(57) ABSTRACT

A gas turbine engine comprises a turbine scroll inside a combustor housing, discouragers with 90-degree bending angles, a radial nozzle contacting a forward bayonet on the forward side of the turbine scroll at a bayonet engagement point and a B-width measured between the discouragers. Retaining ring maintains the size of the B-width. The turbine scroll may have eight surfaces sealing at four locations and a provision to maintain constant "B-width" for the thin sheet metal scroll within the combustion system. The design allows the scroll to operate at high temperature while maintaining lowest possible thermal and mechanical stresses. It can be easily assembled with excellent capability to control gas leakage and minimal component interface wearing or fretting. The gas turbine engine is adapted for aircraft, spacecraft, missiles, and other flight vehicles, especially high performance, high cycle flight vehicles.

14 Claims, 5 Drawing Sheets

MULTI-ACTION ON MULTI-SURFACE SEAL WITH TURBINE SCROLL RETENTION METHOD IN GAS TURBINE ENGINE

GOVERNMENT RIGHTS

The invention was made with Government support under contract number N00019-01-C-3002 with outside funding from Lockheed Martin—US Government under Joint Strike Fighter (JSF) Program. The government has certain rights in this invention.

BACKGROUND OF THE INVENTION

This invention relates to turbine engines, and to a method of preventing the turbine of a turbine engine from choking at high speed. More particularly, it relates to novel improvements to prevent air from compressor discharge to bypass the combustion system. The present invention concerns gas turbine engines for auxiliary power units on aircraft, spacecraft, missiles, and other vehicles.

A typical turbine scroll system is shown in FIG. 1. The prior art gas turbine engine 210 may contain a combustor scroll 240 with a spiral contour and gradual area reduction with one end open for gas inlet and a B-width 250 that covers the entire circumference for gas to exit. Thin sheet metal with a high temperature capability may be used to fabricate the body through a forming process and machined rings may be welded to the sheet metal to form specified interface characteristics and for structural reinforcement. The combustor scroll 240 may be supported at one end, suspended by axial fasteners 220, suspended by a suspension pin 230, or clamped (not shown). This prior art gas turbine engine 210 is adequate only for low cycle and low performance engines. For more advanced systems used on high performance vehicles, such as aircraft, the combustor scroll 240 must meet additional requirements.

Current needs for turbine scroll systems include the ability to control small amounts of gas leakage between components at various operating conditions for performance optimization. Two main operating conditions are an open-loop condition (e.g., ground maintenance or in-flight emergency power) in which the engine runs on its own power and a closed-loop condition (e.g., taxi condition and general flight conditions) in which the engine runs on the bleed gas of the main engine.

Being able to control the size of the B-width (gap between the combustor scroll 240 and associated structures to minimize the gas leakage that can adversely effect the engine performance) may be a concern during engine design and development. Controlling the size of the B-width becomes more critical when an engine is operated in dual modes. Keeping the size of the B-width constant and maintaining effective sealing for system performance and integrity is critical during all operating conditions and surges. A constant B-width size minimizes gas leakage and erosion between components that may cause excessive wear or fretting. Prior art systems usually require tight tolerances for the inner diameters and outer diameters of mating components and shields around surfaces to minimize leakage.

None of the prior art is specifically intended for high performance, high cycle applications, and some suffer from one or more of the following disadvantages:

a) excessive wear and fretting.

b) inability to maintain constant B-width size.

c) ineffective sealing.

d) gas leakage between components.

As can be seen, there is a need for an improved apparatus and method for an improved gas turbine engine system, which minimizes wear and fretting, maintains constant B-width size, and effectively seals to prevent gas leakage between components.

SUMMARY OF THE INVENTION

In one aspect of the present invention, a gas turbine engine comprises: a turbine scroll inside a combustor housing; a forward discourager; an aft discourager; a B-width situated between the forward discourager and the aft discourager; a forward bayonet situated on the forward side of the turbine scroll; a radial nozzle contacting the forward bayonet on the forward side of the turbine scroll at a bayonet engagement point; an aft scroll ring; a retaining ring securing the turbine scroll while maintaining an axial loading point on the aft scroll ring; a forward scroll ring and the retaining ring restraining displacement of the forward scroll ring and the aft scroll ring.

In another aspect of the present invention, a gas turbine engine comprises: a turbine scroll inside a combustor housing; a forward discourager; an aft discourager; a B-width situated between the forward discourager and the aft discourager; a forward axial seal adjacent to the forward discourager; an aft axial seal adjacent to the aft discourager; the forward discourager comprising a 90 degree bending angle; the aft discourager comprising a 90 degree bending angle; a radial nozzle engaged with a forward bayonet on the forward side of the turbine scroll; the forward bayonet contacting the radial nozzle at a bayonet engagement point; an aft scroll ring; a retaining ring adjacent the aft scroll ring; the retaining ring securing the turbine scroll while maintaining an axial loading point on the aft scroll ring; a forward scroll ring; and the retaining ring restraining displacement of forward scroll ring and the aft scroll ring.

In a further aspect of the present invention, a gas turbine engine comprises: a turbine scroll inside a combustor housing; the turbine scroll comprising four pairs of sealing surfaces; a B-width situated between the forward discourager and the aft discourager; a forward bayonet adjacent the forward side of the turbine scroll; the forward bayonet contacting the radial nozzle at a bayonet engagement point a retaining ring adjacent an aft scroll ring; the retaining ring securing the turbine scroll while maintaining an axial loading point on the aft scroll ring; a forward scroll ring; and the retaining ring restraining displacement of the forward scroll ring and the aft scroll ring.

In yet another aspect of the present invention, a gas turbine engine comprises: a compressor section; a combustor section; a compressor scroll; a turbine scroll inside a combustor housing; the turbine scroll comprising four pairs of sealing surfaces; a forward discourager; an aft discourager; a B-width situated between the forward discourager and the aft discourager; a forward axial seal adjacent to the forward discourager; an aft axial seal adjacent to the aft discourager; the forward discourager and the aft discourager comprising a 90 degree bending angle for flow restriction; a radial nozzle engaged with a forward bayonet on the forward side of the turbine scroll in six locations; the forward bayonet contacting the radial nozzle at a bayonet engagement point; a radial seal on the forward side of the B-width; a radial seal on the aft side of the B-width; a retaining ring adjacent an aft scroll ring; the retaining ring securing the turbine scroll while maintaining an axial loading point on the aft scroll ring; a forward scroll ring; and the retaining ring restraining displacement of forward scroll ring and the aft scroll ring.

In another aspect of the present invention, a method is disclosed for preventing a gas turbine engine of an auxiliary power unit from choking at high speed comprises: introducing a portion of the exhaust gas of an associated turbine engine through a radial nozzle; maintaining a constant B-width; securing a retaining ring on the aft side of a turbine scroll while maintaining an axial loading point on the aft side of a scroll ring; and restraining displacement of the turbine scroll by the retaining ring.

These and other aspects, objects, features and advantages of the present invention, are specifically set forth in, or will become apparent from, the following detailed description of a preferred embodiment of the invention when read in conjunction with the accompanying drawings.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
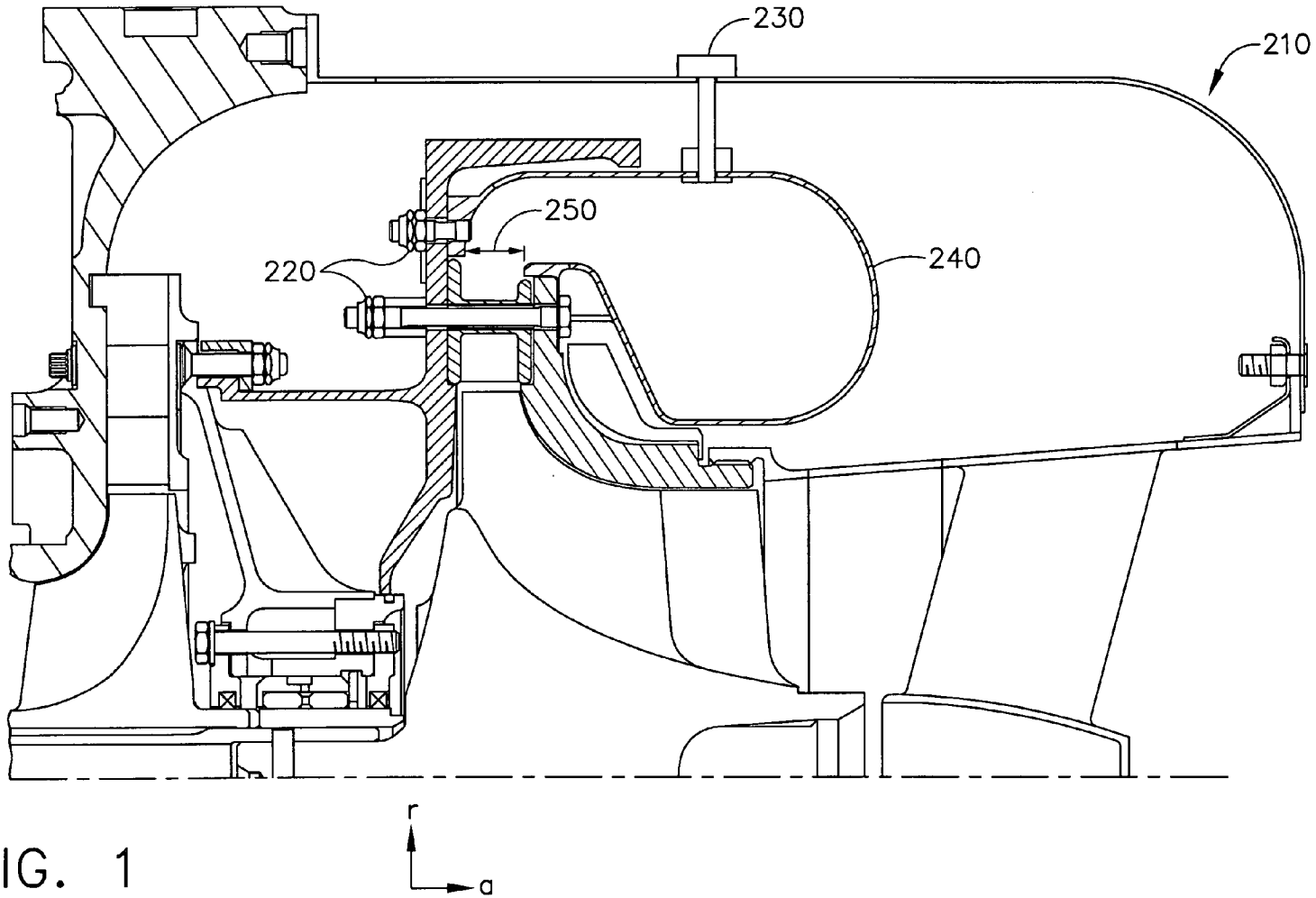
FIG. 1 (PRIOR ART)
FIG. 1 is a cross-sectional view of a prior art gas turbine engine including a scroll structure.

The present invention is useful for auxiliary power units for all types of flight vehicles, including, but not limited to, aircraft, missiles, and spacecraft. As opposed to the prior art gas turbine engine shown in FIG. 1, the present invention does not require suspending the combustor scroll by axial fasteners 220, or suspending the combustor scroll by a suspension pin 230, or clamping. Instead, the present invention uses retaining rings to maintain combustor scroll position, along with eight sealing surfaces at four locations. Such a design allows the combustor scroll to operate at high temperature while maintaining the lowest possible thermal and mechanical stresses as the various turbine components expand or contract in response to temperature fluctuations.

Figure 2:
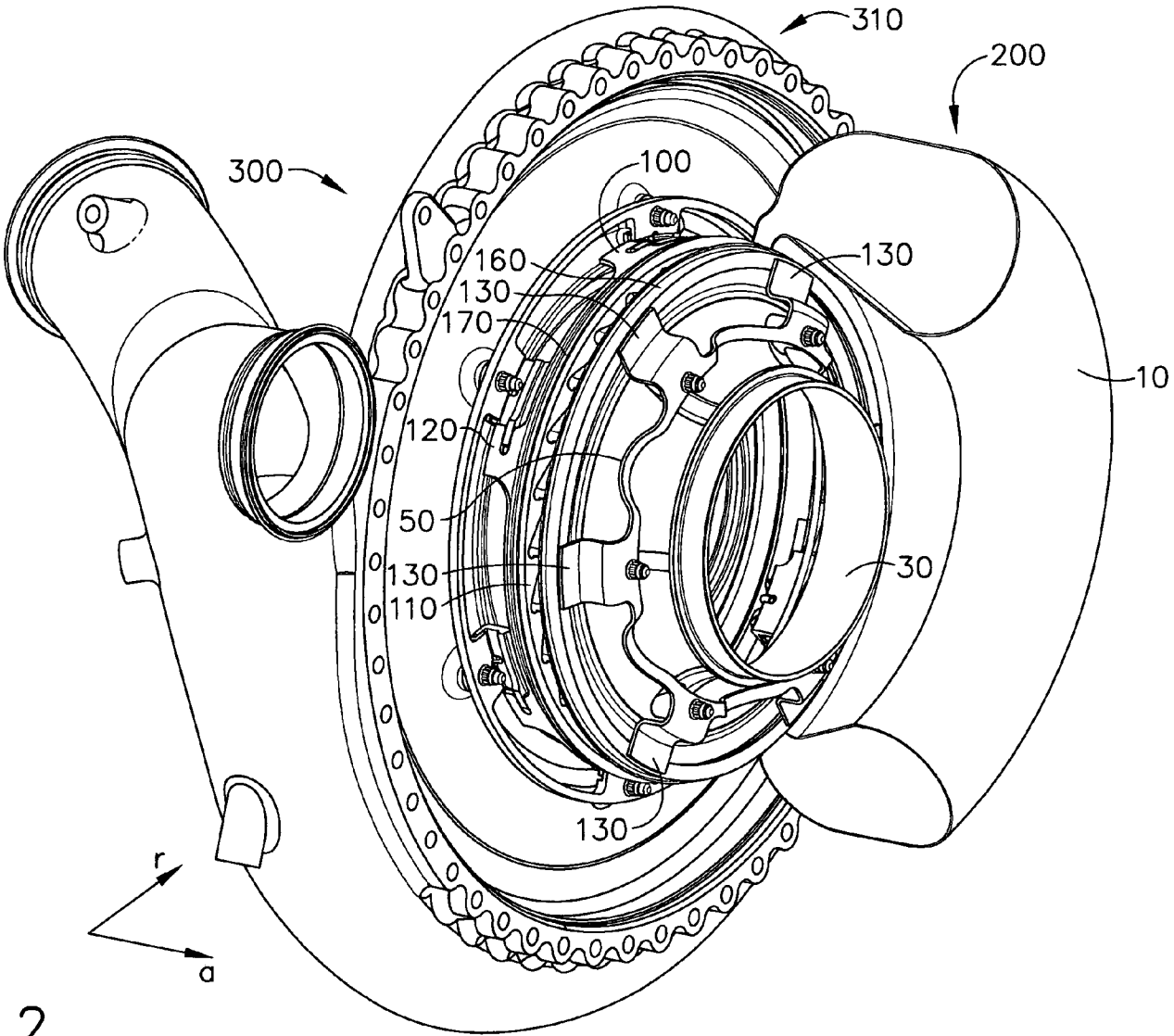
FIG. 2 is a perspective view, partially cut away, of a turbine scroll according to an embodiment of the present invention.
Figure 3:
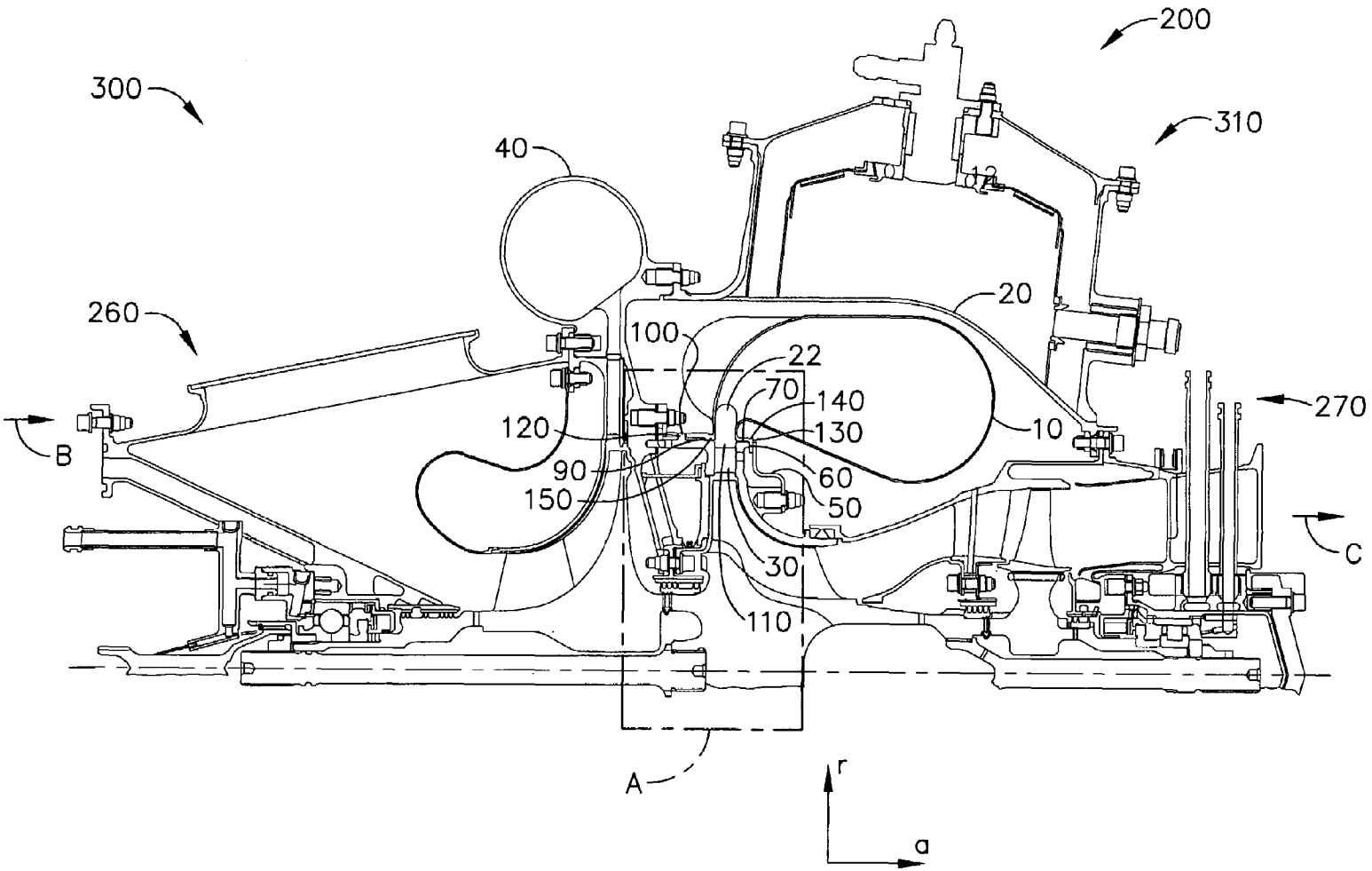
FIG. 3 is an axial cross-sectional view of a gas turbine engine according to an embodiment of the present invention.
Figure 4:
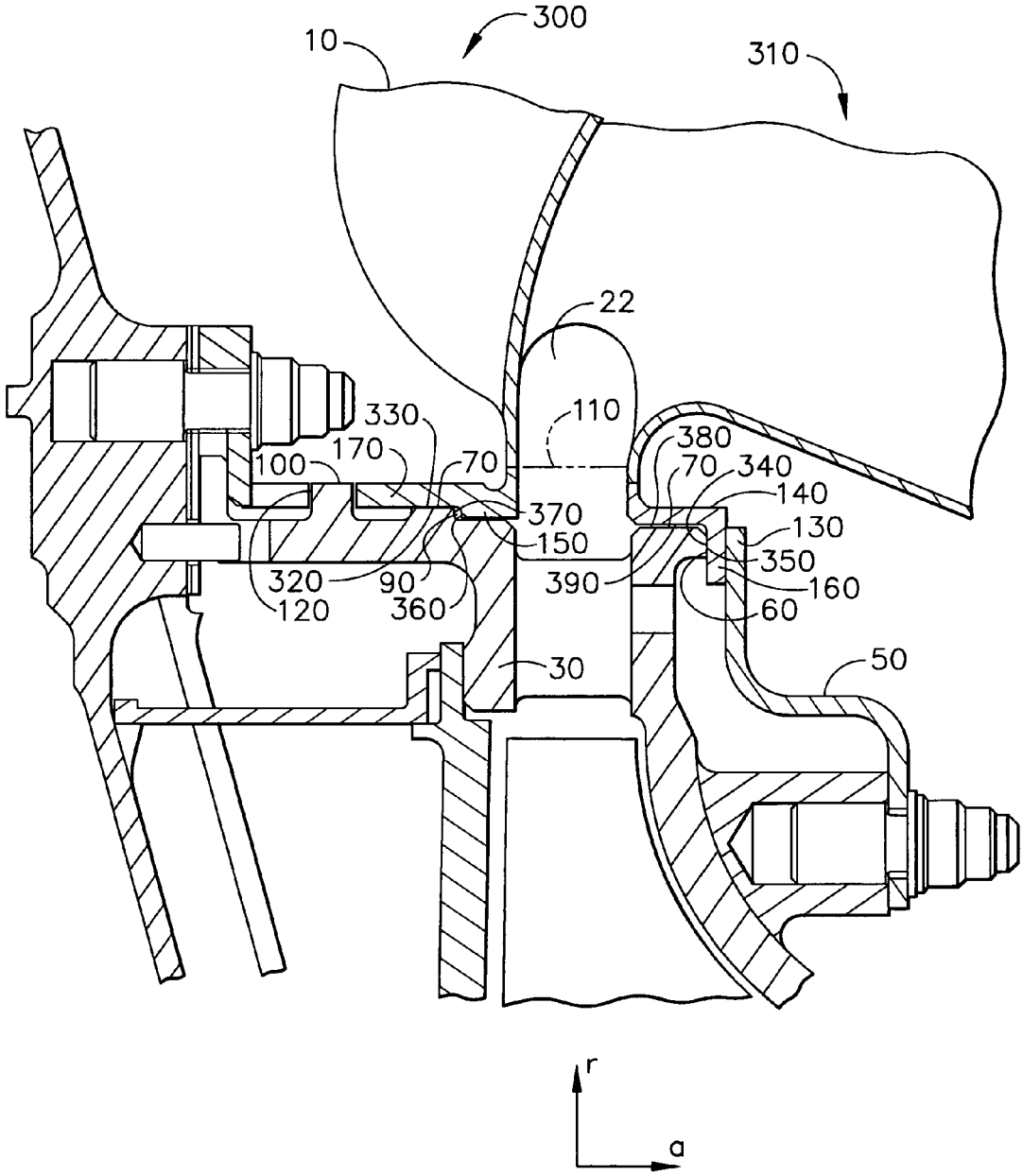
FIG. 4 is an axial cross-sectional view of the inlet region, within the dotted box A in FIG. 3, of a gas turbine engine according to an embodiment of the present invention.

An exemplary gas turbine engine 200 according to the present invention is shown in FIG. 3. The gas turbine engine 200 may comprise a forward side 300 and an aft side 310. The gas turbine engine 200 also may comprise a turbine scroll 10 inside a combustor housing 20, on the aft side 310, and a compressor scroll 40, on the forward side 300. As shown in FIG. 4, which is an enlarged view of section A of FIG. 3, the B-width 110 may be measured as the gap between a forward discourager 150 and an aft discourager 140. As can be seen in the partially cut away perspective view in FIG. 2, a forward bayonet 100 may be situated on the forward side 300 of the turbine scroll 10. A radial nozzle 30 may contact the forward bayonet 100 on the forward side 300 of the turbine scroll 10 at a bayonet engagement point 120 and an aft scroll ring 160.

As in FIG. 3, the turbine scroll 10 may be generally coil-shaped. The turbine scroll 10 may have a spiral contour and gradual area reduction with one end 22 open for gas inlet and the entire circumference across the B-width 110 may serve for gas to exit. The turbine scroll 10 may be constructed of any material suitable for high temperature combustible systems. Examples of suitable materials are nickel alloys, such as Haynes 230 or Hastelloy x.

Figure 5:
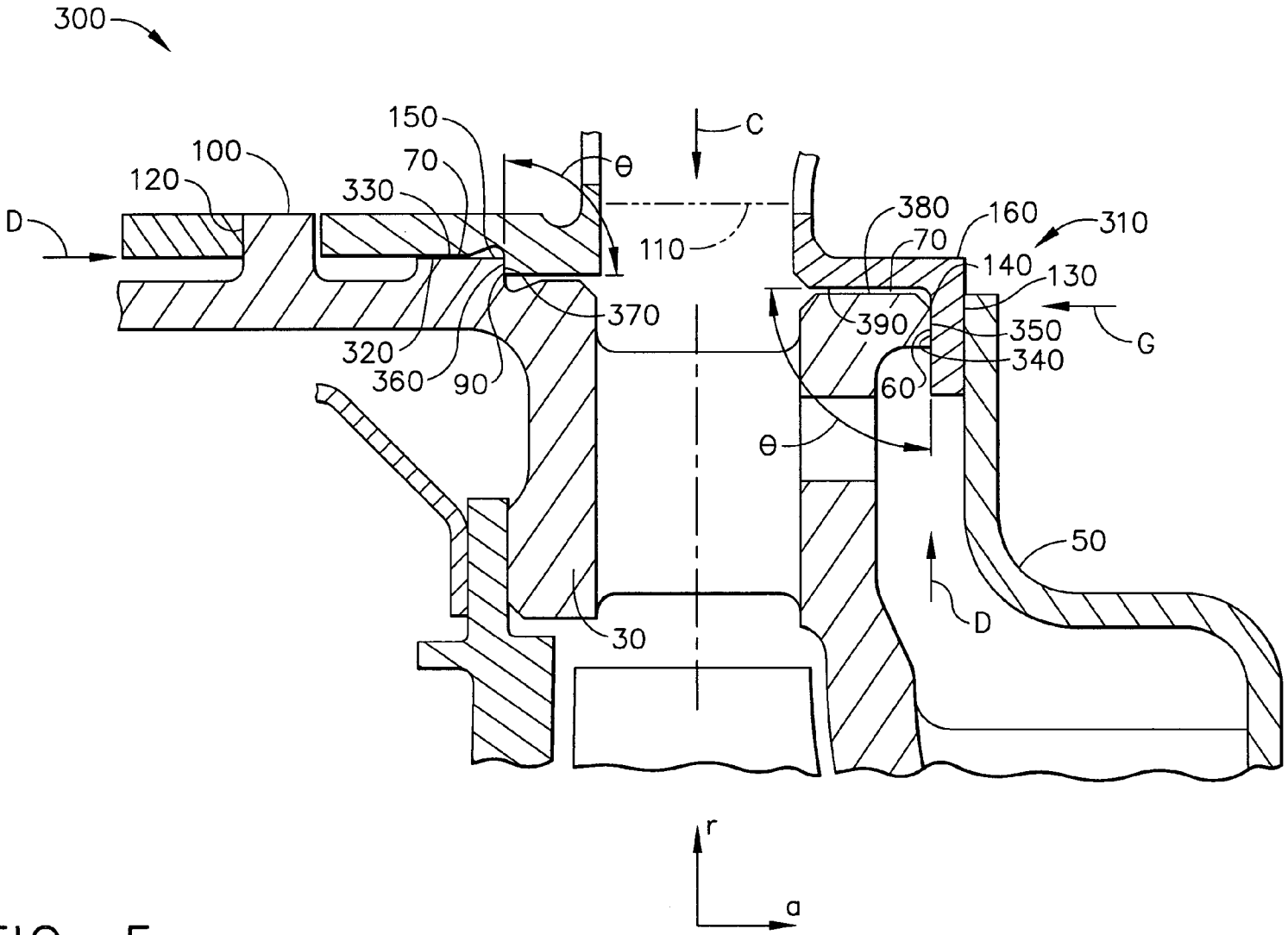
FIG. 5 is an enlarged view of the forward and aft discouragers on either side of the B-width from the central portion of FIG. 4.

Referring to FIG. 5, a further enlarged view of the central portion of the gas turbine engine 200, the significance of the bending angle θ may be seen. Gas flow D restriction through the discouragers 140, 150 by bending, at an angle θ may improve the sealing effectiveness at all engine-operating conditions. The bending angle θ may be in the range from about 60 degrees to about 120 degrees. Preferably, the angle should be at about 90 degrees. The bending angle provides flow restriction when the differential thermal expansion between system components is sufficient to likely cause a misalignment of system components.

With reference to FIG. 2, a retaining ring 50 may secure the turbine scroll 10 in position while maintaining an axial loading point 130 on the aft scroll ring 160 by direct pressure. A forward scroll ring 170 may be used. The retaining ring 50 may restrain axial displacement of the forward scroll ring 170 and the aft scroll ring 160.

Referring back to FIG. 5, using a bending angle θ, such as a 90-degree bending angle, within the forward discourager 150 and/or the aft discourager 140 may restrict gas flow. The B-width 110 may be kept constant by the action of four pairs of sealing surfaces (320, 330; 340, 350; 360, 370; 380, 390); for example, both sides 360, 370 of forward axial seal 90, both sides 340, 350 of aft axial seal 60, both sides 320, 330 of a radial seal 70 on the forward side 300 of the B-width 110, and both sides 380, 390 of a radial seal 70 on the aft side 310 of the B-width 110. This multi-surface configuration may effectively prevent gas leakage despite fluctuations in temperature, pressure, and other conditions occurring in a radial direction r or an axial direction a. A radial seal 70 with surfaces 320, 330 may be located at the forward side 300 of the radial nozzle 30 and a radial seal 70 with surfaces 380, 390 may be located at the aft side 310 of the radial nozzle 30 for sealing the radial nozzle 30 against gas leakage along path D.

The gas flow leakage D on the four pairs of sealing surfaces (320, 330; 340, 350; 360, 370; 380, 390) seals both the forward and aft sides 300, 310 of the turbine scroll 10 while maintaining constant the B-width 110 of the scroll 10. Axial seal 60, 90 surfaces, shown in FIG. 5, withstand interior pressure differentials and mechanical stresses by the forward bayonets 100 at the bayonet engagement points 120 on the forward side 300, and clamped contact (not shown) for the aft end 310, as shown in FIG. 2. The radial seal 70 uses tolerance control and thermal expansion to prevent gas leakage and maintain constant size of the B-width 110. The forward bayonets 100 may be forced to engage with the radial nozzle 30 in several places, for example, at bayonet engagement points 120, preferably at six bayonet engagement points 120 to force axial engagement at 360, 370 to provide a adequate seal for minimizing gas leakage on the path D. The aft scroll ring 160 may be forced, for example, in direction G, into contact with the radial nozzle 30 by the retaining ring 50 to produce a contact surface 340, 350 for sealing. The four sealing surfaces (320, 330; 340, 350; 360, 370; 380, 390) work synchronically under the higher pressures from the compressor scroll 40 under high performance conditions that may force axial contact on the forward end 300 of the B-width 110.

A method for preventing a gas turbine engine of an auxiliary power unit from choking at high speed may comprise diverting a portion of the exhaust gas of an associated turbine engine by about 90 degrees in flow direction; maintaining a constant B-width 110; introducing the diverted exhaust gas through a radial nozzle 30; securing a retaining ring 50 on the aft side 310 of a turbine scroll 10 while maintaining an axial loading point 130 on the aft side 310 of a scroll ring by direct pressure; restraining displacement of the turbine scroll 10 by the retaining ring 50; and, further reinforcing contact at an axial loading point 130 on the aft side 310 of the scroll ring by direct pressure.

Although the present invention has been described in considerable detail with reference to certain preferred versions thereof, other versions are possible. Therefore, the spirit and scope of the appended claims should not be limited to the description of the preferred versions contained therein.

We claim:

1. A gas turbine engine comprising:
a turbine scroll inside a combustor housing;
a forward discourager;
an aft discourager;
a B-width, measured between the forward discourage and the aft discourager;
a forward bayonet situation on the forward side of the turbine scroll;
a radial nozzle contacting the forward bayonet on the forward side of the turbine scroll at a bayonet engagement point;
an aft scrolling;
a retaining ring securing the turbine scroll while maintaining an axial loading point on the aft scroll ring;
a forward scroll ring; and
the retaining ring restraining displacement of the forward scroll ring and the aft scroll ring;
wherein the forward discourager comprises a bending angle of about 90 degrees.

2. The gas turbine engine of claim 1, wherein the aft discourage comprises a bending angle within the range of from about 60 degrees to about 120 degrees.

3. The gas turbine engine of claim 2, wherein the aft discourager comprises a bending angle of about 90 degrees.

4. The gas turbine engine of claim 1, wherein the turbine scroll further comprises four pairs of sealing surfaces.

5. The gas turbine engine of claim 1, further comprising a radial seal at the forward side of the radial nozzle and a radial seal at the aft side of the radial nozzle for sealing the radial nozzle against leaking of exhaust gas.

6. The gas turbine engine of claim 1, wherein the turbine scroll is generally coil-shaped.

7. The gas turbine engine comprising:
a turbine scroll inside a combustor housing;
a forward discourager;
an aft discourager;
a B-width, measured between the forward discourager and the aft discourager;
a forward axial seal adjacent to the forward discourager;
an aft axial seal adjacent to the aft discourager;
the forward discourager comprising a 90-degree bending angle;
an aft discourager comprising a 90-degree bending angle;
a radial nozzle engaged with a forward bayonet on the forward side of the turbine scroll;
the forward bayonet contacting the radial nozzle at a bayonet engagement point;
an aft scroll ring;
a retaining ring adjacent the aft scroll ring;
the retaining ring securing the turbine scroll while maintaining an axial loading point on the aft scroll ring; and
a forward scroll ring;
the retaining ring restraining displacement of forward scroll ring and the aft scroll ring.

8. The gas turbine engine of claim 7, wherein the turbine scroll further comprises four pairs of sealing surfaces.

9. The gas turbine engine of claim 7, further comprising a radial seal at the forward side of the radial nozzle and a radial seal at the aft side of the radial nozzle for sealing the radial nozzle against leaking of exhaust gas.

10. A gas turbine engine comprising:
a turbine scroll inside a combustor housing;
the turbine scroll comprising four pairs of sealing surfaces;
a B-width, measured between a forward discourager and an aft discourager, wherein said B-width is kept constant by action of said four pairs of sealing surfaces;
the forward discourager and the aft discourager comprising a 90-degree bending angle for flow restriction;
a forward bayonet adjacent the forward side of the turbine scroll;
the forward bayonet contacting a radial nozzle at a bayonet engagement point;
a retaining ring adjacent an aft scroll ring;
the retaining ring securing the turbine scroll while maintaining an axial loading point on the aft scroll ring; and
a forward scroll ring;
the retaining ring restraining displacement of the forward scroll ring and the aft scroll ring.

11. The gas turbine engine of claim 10, wherein the turbine scroll is generally coil-shaped.

12. A gas turbine engine comprising:
a compressor section;
a combustor section;
a compressor scroll;
a turbine scroll inside a combustor housing;
a forward discourager;
an aft discourager;
a B-width, measured between the forward discourager and the aft discourager;
a forward axial seal adjacent to the forward discourager;
an aft axial seal adjacent to the aft discourager;
the forward discourager and the aft discourager comprising a 90-degree bending angle for flow restriction;
a radial nozzle engaged with a forward bayonet on the forward side of the turbine scroll in six locations;
the forward bayonet contacting the radial nozzle at a bayonet engagement point;
a radial seal on the forward side of the B-width;
a radial seal on the aft side of the B-width;
a retaining ring adjacent an aft scroll ring;
the retaining ring securing the turbine scroll while maintaining an axial loading point on the aft scroll ring; and
a forward scroll ring;
the retaining ring restraining displacement of forward scroll ring and the aft scroll ring.

13. The gas turbine engine of claim 12, wherein the turbine scroll is generally coil-shaped.

14. The gas turbine engine of claim 12, wherein the turbine scroll comprises four pairs of sealing surfaces.

* * * * *